United States Patent [19]

Otsuka

[11] Patent Number: 4,897,938

[45] Date of Patent: Feb. 6, 1990

[54] SHOE FREELY FITTING TO A FOOT AND A FOOT BED

[76] Inventor: Akira Otsuka, 13, Nanpeidai-Cho, Tokyo, Japan

[21] Appl. No.: 150,646

[22] PCT Filed: May 9, 1987

[86] PCT No.: PCT/JP87/00287

§ 371 Date: Jan. 7, 1988

§ 102(e) Date: Jan. 7, 1988

[87] PCT Pub. No.: WO87/06804

PCT Pub. Date: Nov. 19, 1987

[30] Foreign Application Priority Data

May 9, 1986 [JP] Japan ..... 61-104858
Nov. 5, 1986 [JP] Japan ..... 61-261944

[51] Int. Cl.[4] ..... A43B 7/14; A43B 3/26; A43B 13/38

[52] U.S. Cl. ..... 36/88; 36/8.4; 36/43; 36/93; 128/581

[58] Field of Search ..... 36/88, 43, 44, 93, 8.4, 36/97; 128/58, 586, 595, 617; 12/146 B, 146 BZ; 33/3 R, 3 A, 5

[56] References Cited

U.S. PATENT DOCUMENTS

| | | | |
|---|---|---|---|
| 1,370,799 | 3/1921 | Egerton | 36/44 X |
| 2,008,207 | 7/1935 | Greenberg | 36/43 X |
| 4,413,430 | 11/1983 | Brown | 36/44 |
| 4,520,581 | 6/1985 | Irwin et al. | 36/88 |
| 4,633,877 | 1/1987 | Pendergast | 128/581 |
| 4,680,877 | 7/1987 | Fink | 36/44 |

FOREIGN PATENT DOCUMENTS

| | | | |
|---|---|---|---|
| 2144881 | 3/1973 | Fed. Rep. of Germany | 36/93 |
| 3009247 | 9/1981 | Fed. Rep. of Germany | 128/581 |
| 3212644 | 10/1983 | Fed. Rep. of Germany | 36/88 |
| 2573633 | 5/1986 | France | 36/43 |
| 110854 | 11/1917 | United Kingdom | 36/8.4 |
| 2138271 | 10/1984 | United Kingdom | 36/43 |

*Primary Examiner*—James Kee Chi
*Attorney, Agent, or Firm*—Fidelman & Wolffe

[57] ABSTRACT

A combination of a shoe and a foot bed in which a predetermined foot girth is obtained by inserting a foot bed having a three dimensional shape adaptable to the shape of a bottom of a foot, for which the degree of fitness has been confirmed by placing a foot thereon, into a shoe having a foot length of a standard size and a foot girth larger than a standard size.

6 Claims, 5 Drawing Sheets

SHOE FREELY FITTING TO A FOOT AND A FOOT BED

FIELD OF TECHNOLOGY

The present invention relates to a shoe which fits to a foot freely and to a foot bed which also fits to a foot freely.

BACKGROUND OF THE INVENTION

In a prior art shoe, the foot girth is fixed individually. However, the foot for using it differs significantly in the foot girth from person to person even for the same foot length. For this reason, recently, along with an enhancement of the consumer level, shoes with various kinds of foot girths are prepared for various kinds of foot lengths. However, for that purpose, from a manufacturing standpoint, it is necessary to prepare separate lasts and last fittings or the like for different foot girths even for a shoe having the same design, method of manufacture, material and foot length, and dealers are also required to retain a multiple of stocks, which is disadvantageous. In particular, in the case of selecting an appropriate shoe among these stocks, a determination is normally made by actually wearing shoes of various foot girths of the same foot length which is used as a reference, so that each time the product value of a shoe deteriorates.

On the other hand, if a shoe fits loosely on the foot, there is a conventional method for implementing adjustments by placing plate-shaped whole length socks or inserts one on top of another; however, according to this method, even though adjustments can be made for the foot height, no adjustments can be made for the foot width and foot bottom surface. Under this condition, a shoe must be worn with unpleasantness and the presence of a cause for health injury.

As set forth above, in accordance with the prior art method, even for the same foot length, ones having various kinds of foot girths must be prepared and glued, and it is the current situation that an objective cannot be attained even if it is tried to adjust the foot girth by a plate-shaped whole length sock. Besides, adjustments cannot be carried out for the reality in which the right and left human feet inherently differ.

And yet, in selecting shoes, since a determination is made by wearing those among the stocks which appear to be appropriate, the product value deteriorates each time and it is difficult to select perfect ones because the degree of fitness to the feet cannot be viewed from the exterior.

DISCLOSURE OF THE INVENTION

In order to solve the above-described problems, the present invention includes the following structure.

(1) In a combination of a shoe main body having a foot length of a standard size and a foot girth or inner circumference larger than a standard size and a whole length sock (insert) detachably mounted within said shoe main body and of a three dimensional shape having a foot girth altering function, said whole length sock of a three dimensional shape having a foot girth altering function including an appropriate number, each having a surface shape or contour which adapts to the shape of a foot bottom and having a differing thickness, or including a base portion having a surface shape which adapts to the shape of foot bottom and an appropriate number of auxiliary portions having a shape close to a plate-shape, which are used as overlying or underlying the base portion.

(2) A foot bed having a three dimensional shape which adapts to the shape of a foot bottom, on which a foot may be placed in advance to confirm the degree of fitness by observing visually and touching by a hand, said foot bed being inserted into a predetermined shoe having a foot length of a standard size and a foot girth larger than a standard size to thereby obtain a foot girth of a standard size, and said foot bed being manufactured and used in a set for several kinds (for example, four kinds of A, B, C and D) different in shape for each foot length, these foot beds mainly having different thicknesses at a central portion in the longitudinal direction and having three dimensional shapes substantially same in thickness at the front and rear portions.

BEST MODE FOR PRACTICING THE INVENTION

Figure 1A:
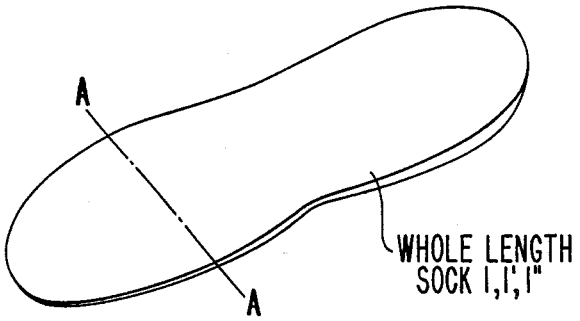
FIGS. 1 through 3 illustrate three embodiments of a shoe in accordance with the present invention.
Figure 1C:
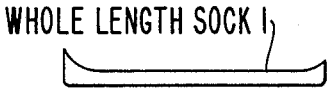
Figure 1B:
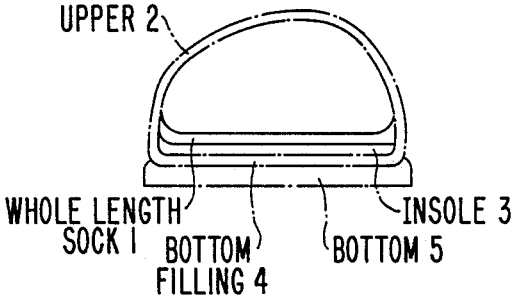
Figure 1D:
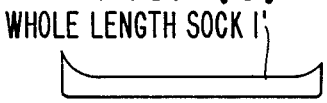
Figure 1E:
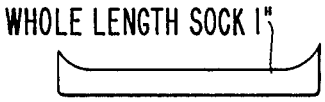

In order to describe the present invention more in detail, the mode of practice of the present invention will be described with reference to the attached drawings hereinbelow.

FIG. 1 illustrates a first embodiment of a shoe in accordance with the present invention, in which (A) shows a perspective view of a whole length sock; and (B) shows a cross-sectional view along A—A line in (A); moreover, (C), (D) and (E) show cross-sectional views of three kinds of a whole length sock. As shown in (B), a shoe main body is fabricated by a prior art method of manufacture using an upper 2, an insole 3, a bottom filling 4 and a bottom 5, whereby the foot length corresponds to a standard size of JIS, but its foot girth is made to be larger than a standard size. As shown in (A), the whole length sock is of a three dimensional shape having a surface which adapts to the shape of a foot bottom, and it is fabricated, for example, by molding of plastics.

Taking the maximum foot girth 3E as an example, the shoe main body is manufactured by a prior art method of manufacture using a last which adapts to 3E under the condition with the whole length sock 1 inserted therein. Other than the whole length sock 1 (shown in FIG. 1 (A) and (C) adapted to 3E, the whole length socks 1' and 1'', having a surface shape adaptable to the shape of a foot bottom and different sizes, as shown in (D) and (E), are manufactured. And, when using these in place of 1, they provide −6 mm and −12 mm in foot girth, respectively, thereby adapting to foot girths of 2E and E, respectively.

In this manner, using three kinds of whole length socks having a surface shape adaptable to the shape of a foot bottom and differing in thickness, shoes adaptable not only in foot height but also in foot width and foot bottom surface or contour can be provided by a pair of shoes fabricated by the same last for people having three different kinds of foot girths or for the same people differing in foot girth or foot length between left and right.

Figure 2A:
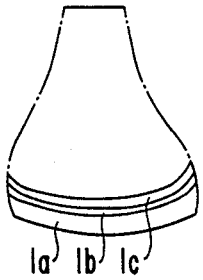
Figure 2B:
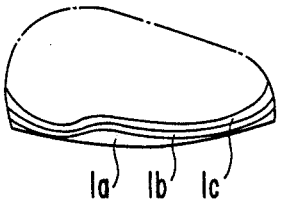
Figure 2C:
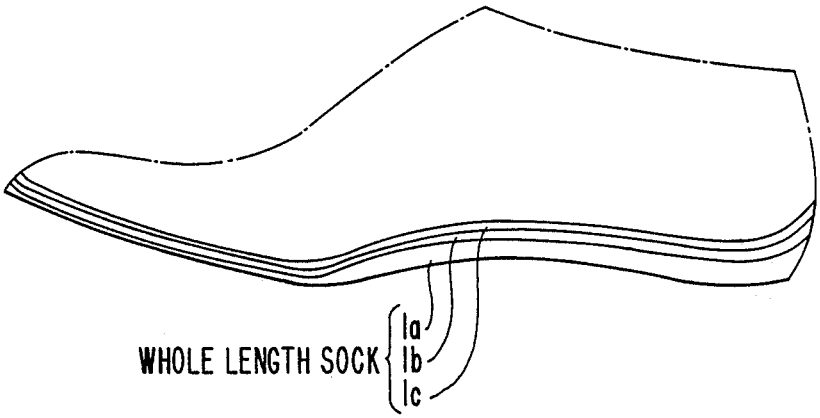

FIG. 2 illustrates a second embodiment of a shoe in accordance with the present invention, in which (A) is a cross-sectional view of a heel portion of a whole length sock and (B) and (C) are similarly cross-sectional views of a stepping portion and a foot length portion. In this case, it is intended to produce the same effect as that of the first embodiment by placing three sheets of whole length socks 1*a* (a base portion having a surface shape which adapts to the shape of a foot bottom), 1*b* (a plate-shaped auxiliary portion) and 1*c* (a plate-shaped auxiliary portion) one on top of another, and the respective correspondences are as follows:

| | | |
|---|---|---|
| 3E | 1 in FIG. 1 | 1a in FIG. 2 |
| 2E | 1' in FIG. 1 | 1a + 1b in FIG. 2 |
| E | 1" in FIG. 1 | 1a + 1b + 1c in FIG. 2 |

Figure 3:
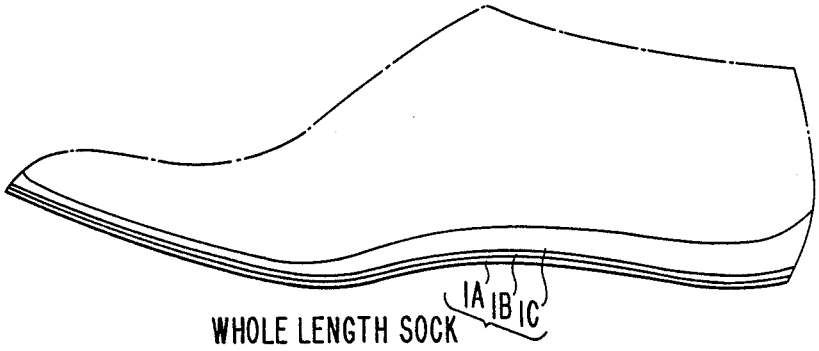

FIG. 3 illustrates a third embodiment of a shoe in accordance with the present invention and is a cross-sectional view of a foot length portion of a whole length sock. In this case, it is intended to produce the same effect as that of the first embodiment by placing three sheets of whole length socks 1A (a base portion having a surface shape which adapts to the shape of a foot bottom), 1B (a plate-shaped auxiliary portion) and 1C (a plate-shaped auxiliary portion) one on top of another, and the respective correspondences are as follows:

| | | |
|---|---|---|
| 3E | 1 in FIG. 1 | 1A in FIG. 3 |
| 2E | 1' in FIG. 1 | 1A + 1B in FIG. 3 |
| E | 1" in FIG. 1 | 1A + 1B + 1C in FIG. 3 |

Incidentally, in the present embodiment, it is possible for the auxiliary portion 1B or 1C, for example, to have a shape which differs in thickness between left and right rather than a simple plate-shape, in which case the degree of fitness of the present invention can be further enhanced.

Table 1 is a table which illustrates one example in which foot beds of the present invention different in shape are to be manufactured in sets, wherein 23–26½ indicates the foot length and E, EE–EEEE, F indicates the foot girth.

TABLE 1

| SIZE | E | EE | EEE | EEEE | F | SHOE |
|---|---|---|---|---|---|---|
| 23 | | $A_1$ | $B_1$ | $C_1$ | $D_1$ | |
| 23½ | $A_1$ | $B_1$ | $C_1$ | $D_1$ | | $X_1$ |
| 24 | | $A_2$ | $B_2$ | $C_2$ | $D_2$ | |
| 24½ | $A_2$ | $B_2$ | $C_2$ | $D_2$ | | $X_2$ |
| 25 | | $A_3$ | $B_3$ | $C_3$ | $D_3$ | |
| 25½ | $A_3$ | $B_3$ | $C_3$ | $D_3$ | | $X_3$ |
| 26 | | $A_4$ | $B_4$ | $C_4$ | $D_4$ | |
| 26½ | $A_4$ | $B_4$ | $C_4$ | $D_4$ | | $X_4$ |

The table has been made for the foot lengths 23–26½ assuming for normal men, and it is intended to cover foot girths (E, EE–EEEE, F) for the foot lengths 23–26½ of normal men by four different kinds of shoes and sixteen different kinds of foot beds, i.e., shoes including four kinds of $X_1$, $X_2$, $X_3$ and $X_4$ and foot beds including four kinds of $A_1$, $B_1$, $C_1$ and $D_1$ for $X_1$; four kinds of $A_2$, $B_2$, $C_2$ and $D_2$ for $X_2$; four kinds of $A_3$, $B_3$, $C_3$ and $D_3$ for $X_3$; and four kinds of $A_4$, $B_4$, $C_4$ and $D_4$ for $X_4$.

Figure 4:
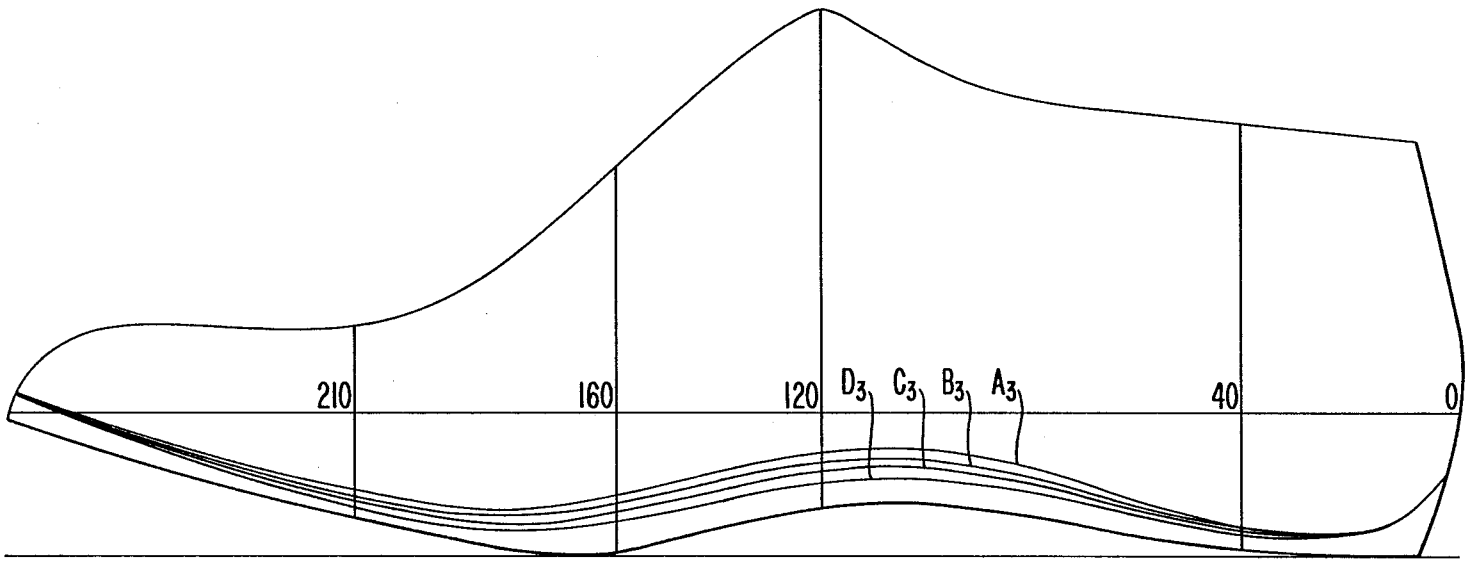
FIGS. 4 through 8 illustrate one example of a foot bed in accordance with the present invention.
Figure 6:
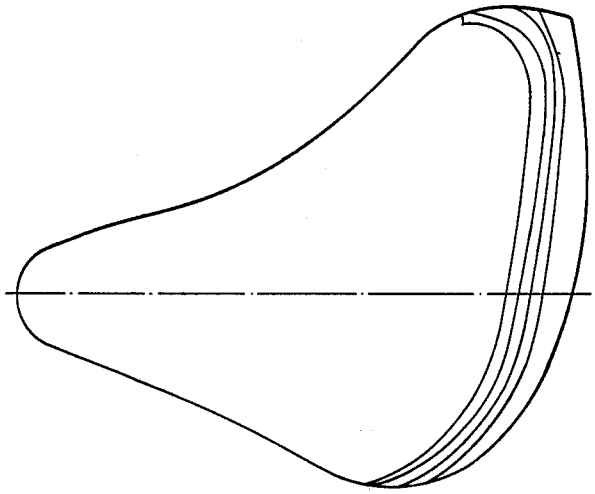
Figure 5:
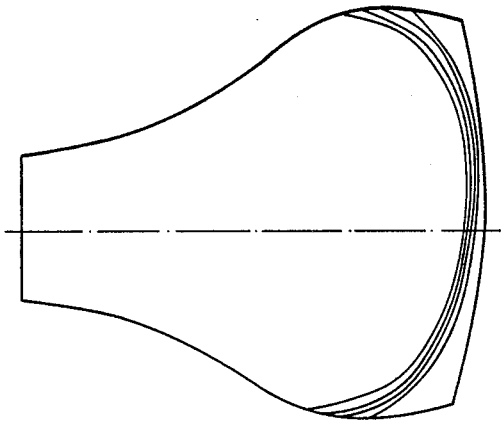
Figure 7:
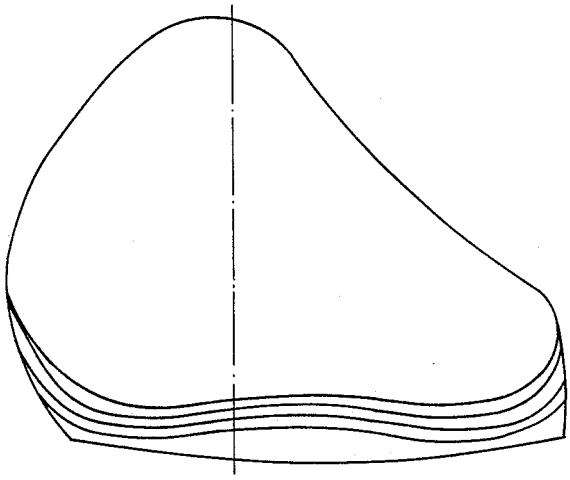
Figure 8:
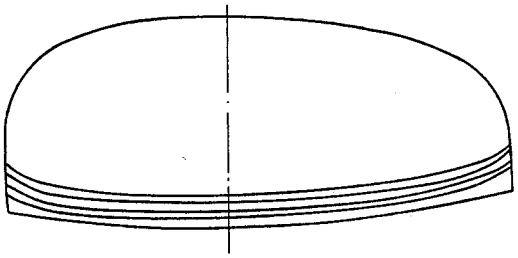

The drawings are cross-sectional views showing one example of a foot bed of the present invention, and it conveniently shows in combination the shapes of top surfaces of four kinds of $A_3$–$D_3$ for use in a shoe of $X_3$ corresponding to sizes 25–25½. FIG. 4 is a central, longitudinal, cross-sectional view and FIGS. 5, 6, 7 and 8 are transverse cross-sectional views at points 40 mm, 120 mm, 160 mm and 210 mm from the rear portion, respectively.

As understood from the drawings, the shape of each of beds $A_3$–$D_3$ differs in thickness at the central portion in the longitudinal direction; however, the front portion, and, in particular, the rear portion has a three dimensional shape substantially same in thickness. Thus, there is no increased tendency for the shoe to slip from the heel of the user since the heel engaging portion of the shoe is not substantially reduced when this foot bed is in the shoe.

Next, it will be described as to the method of usage of a foot outfit of the present invention. Now, assuming that a person having a foot whose foot length size is 25 has come to a store, a shoe of $X_3$ and foot beds of $A_3$, $B_3$, $C_3$ and $D_3$ are prepared for size 25 at the store. The shoe of $X_3$ is for the foot lengths 25 and 25½, and the foot girth is larger than the maximum standard size (e.g., 270 mm corresponding to size 25½). In addition, regarding the shape of the foot bed, $A_3$ is the thickest and it becomes thinner in the order of $B_3$, $C_3$ and $D_3$.

A dealer selects an appropriate one among $A_3$–$D_3$ by looking at the shape of a foot of the customer and confirms the degree of fitness with the foot by eyes and touches with the foot of the customer placed thereon. For example, if $B_3$ has been selected, this is inserted into the shoe $X_3$ which is then worn to verify the wearing comfortableness. If the upper of the shoe has changed due to aging as a result of wearing it for a long time by the customer, adjustments may be made by exchanging with a thicker $A_3$.

A foot bed of the present invention preferably is prefabricated and preshaped to fit closely to the bottom of a foot, for example, by mold processing of a soft plastic material, such as polyurethane, EVA and PVC, and synthetic rubber. However, it is easy to carry out various modified processing by providing irregularities at the surface or mixing with an odor removing agent.

As is apparent from the above description, in accordance with the present invention, since adaptation may be made to a desired kind of foot girth by changing a whole length sock of a pair of shoes, the stock may be reduced at manufacture, whole sale and retailers. In addition, since the degree of fitness is confirmed by observing with eyes and touching by hands with a foot placed on a foot bed, the most comfortable wearing condition can be obtained, which could contribute to pleasant walking and enhancement of health, prevent the occurrence of deterioration of product value at the time of shoe selection and allow to preserve a pleasant wearing comfortableness, as different from a prior art plate-shaped whole length sock which is thick at the front and rear portions corresponding to changes in the upper of a shoe due to aging, which is poor in wearing comfortableness.

INDUSTRIAL APPLICABILITY

As described in detail, a shoe which fits freely to a foot and a foot bed in accordance with the present invention is expected to provide a significant innovation in the shoe-making industry.

I claim:

1. A combination of a shoe comprising a main body having a longitudinal length corresponding to one of several standardized lengths and an inner circumference which is larger than inner circumferences corresponding to said standardized length, and a plurality of foot supporting inserts detachably insertable within said shoe main body to complete said shoe, said inserts each having a shoe engaging surface and a foot engaging surface, said shoe engaging surface of each said insert being nestable within and substantially identical in contour to a corresponding inner portion of said shoe, said foot engaging surface being prefabricated and preshaped and varying from insert to insert so as to fit foot bottoms different in width and to conform generally to different contours of feet such that said shoe main body is fittable to different feet according to selection of one of said inserts.

2. The combination of claim 1, wherein said inserts are whole length socks.

3. The combination of claim 1, wherein each of said plurality of inserts has a different thickness at least locally.

4. A combination of a shoe comprising a main body having a length corresponding to one of several standardized sizes and an inner circumference which is larger than inner circumferences corresponding to said length, a foot supporting insert detachably insertable into said shoe main body and having a top surface prefabricated and preshaped and varying from insert to insert so as to fit foot bottoms of various widths and to conform generally to different contours of feet, and a plurality of intermediate supports which are generally flat and identical in structure and detachably insertable between said shoe main body and said foot supporting insert whereby at least one of said plurality of intermediate supports is selectively insertable into said shoe main body underneath said insert for purposes of fitting said shoe to a foot.

5. The combination of claim 4, wherein said insert and said intermediate supports are whole length socks.

6. The combination of claim 4, wherein said inner circumference is determined by an inner width and an inner height of said shoe main body.

* * * * *